US006423942B1

(12) United States Patent
Liao

(10) Patent No.: US 6,423,942 B1
(45) Date of Patent: Jul. 23, 2002

(54) PORTABLE HAIR CURLER HAVING LAMP TYPE HEAT SOURCE MEMBER

(75) Inventor: Feng-Chih Liao, Tantzu (TW)

(73) Assignee: Nanica-Taiwan Incorporated, Tantau (TW)

( * ) Notice: Subject to any disclaimer, the term of this patent is extended or adjusted under 35 U.S.C. 154(b) by 0 days.

(21) Appl. No.: 09/949,573

(22) Filed: Sep. 11, 2001

(51) Int. Cl.[7] ..... A45D 1/04

(52) U.S. Cl. ..... 219/222; 219/227; 392/409; 132/229

(58) Field of Search ..... 219/222–226, 219/227; 392/409; 132/223–232

(56) References Cited

U.S. PATENT DOCUMENTS 4,354,092 A * 10/1982 Manabe et al. ..... 219/225
4,602,143 A * 7/1986 Mack et al. ..... 219/225
4,883,942 A * 11/1989 Robak, Sr. et al. ..... 219/227
4,939,340 A * 7/1990 Brill ..... 219/225
6,053,180 A * 4/2000 Kwan ..... 132/232
2001/0013513 A1 * 8/2001 Chan ..... 219/225

FOREIGN PATENT DOCUMENTS

DE 2720961 * 11/1978
DE 2819725 * 11/1979

* cited by examiner

*Primary Examiner*—John A. Jeffery
(74) *Attorney, Agent, or Firm*—Rosenberg, Klein & Lee

(57) ABSTRACT

A portable hair curler having a lamp type heat source member, includes a heat emitting lamp seat that may co-operate with a lamp type heat source member, thereby forming a portable heat source that may be carried freely and replaced easily, thereby enhancing the versatility of the portable hair curler.

9 Claims, 9 Drawing Sheets

PORTABLE HAIR CURLER HAVING LAMP TYPE HEAT SOURCE MEMBER

BACKGROUND OF THE INVENTION

1. Field of the Invention

The present invention relates to a portable hair curler having a lamp type heat source member, and more particularly to a portable hair curler having a lamp type heat source member, wherein a heat emitting lamp seat may co-operate with a lamp type heat source member, thereby forming a portable heat source that may be carried freely and replaced easily, thereby enhancing the versatility of the portable hair curler.

2. Description of the Related Art

A conventional hair curler comprises a handle having a front end provided with a heating member, and a rear end connected to an electric cord. However, the conventional hair curler has the following disadvantages.

1. The conventional hair curler has to connect the electric cord, so that the conventional hair curler cannot be used at a distal position and cannot also be used outdoors, thereby limiting the versatility of the conventional hair curler.
2. The operation of the conventional hair curler is easily interrupted by the electric cord, thereby causing inconvenience to the user.
3. The heating member of the conventional hair curler is often a heated filament which is very expensive and has a complicated structure, thereby increasing the cost of fabrication.
4. The heated filament is easily worn out due to collision, so that it is necessary to replace the entire hair curler when the heated filament is broken, thereby causing consumption of cost.
5. The conventional hair curler can be used to dress the hair only without any other function, thereby limiting the versatility of the conventional hair curler.

SUMMARY OF THE INVENTION

The primary objective of the present invention is to provide a portable hair curler having a lamp type heat source member, wherein a heat emitting lamp seat may co-operate with a lamp type heat source member, thereby forming a portable heat source that may be carried freely and replaced easily, thereby enhancing the versatility of the portable hair curler.

In accordance with the present invention, there is provided a portable hair curler having a lamp type heat source member, comprising: a handle having a first end provided with a heat emitting housing which contains a net-shaped heat-sink member therein, and a hair roller member mounted on an outside of the heat emitting housing;

the first end of the handle provided with a tongue, and a thumb press for elastically pressing the tongue to mate with the heat emitting housing to clip and hold hair;

the thumb press of the handle having an end face provided with a locking hole, the hair roller member provided with an elastic locking portion that may be snapped into the locking hole of the thumb press of the handle;

the net-shaped heat-sink member mounted in a hollow inner wall of the heat emitting housing, so that heat may be evenly distributed around a periphery of the heat emitting housing through the net-shaped heat-sink member;

wherein:

the handle has a second provided with a hollow power supply chamber for receiving therein at least one chargeable electric source member, a control circuit member is mounted in the power supply chamber, a heat emitting lamp seat has a first end mounted on the first end of the handle and electrically connected to the electric source member, a lamp type heat source member is inserted on a second end of the heat emitting lamp seat, the control circuit member may be controlled by a switch to supply electric power to the heat emitting lamp seat, so that the lamp type heat source member may be heated or turned off.

Further benefits and advantages of the present invention will become apparent after a careful reading of the detailed description with appropriate reference to the accompanying drawings.

DETAILED DESCRIPTION OF THE INVENTION

Figure 1:
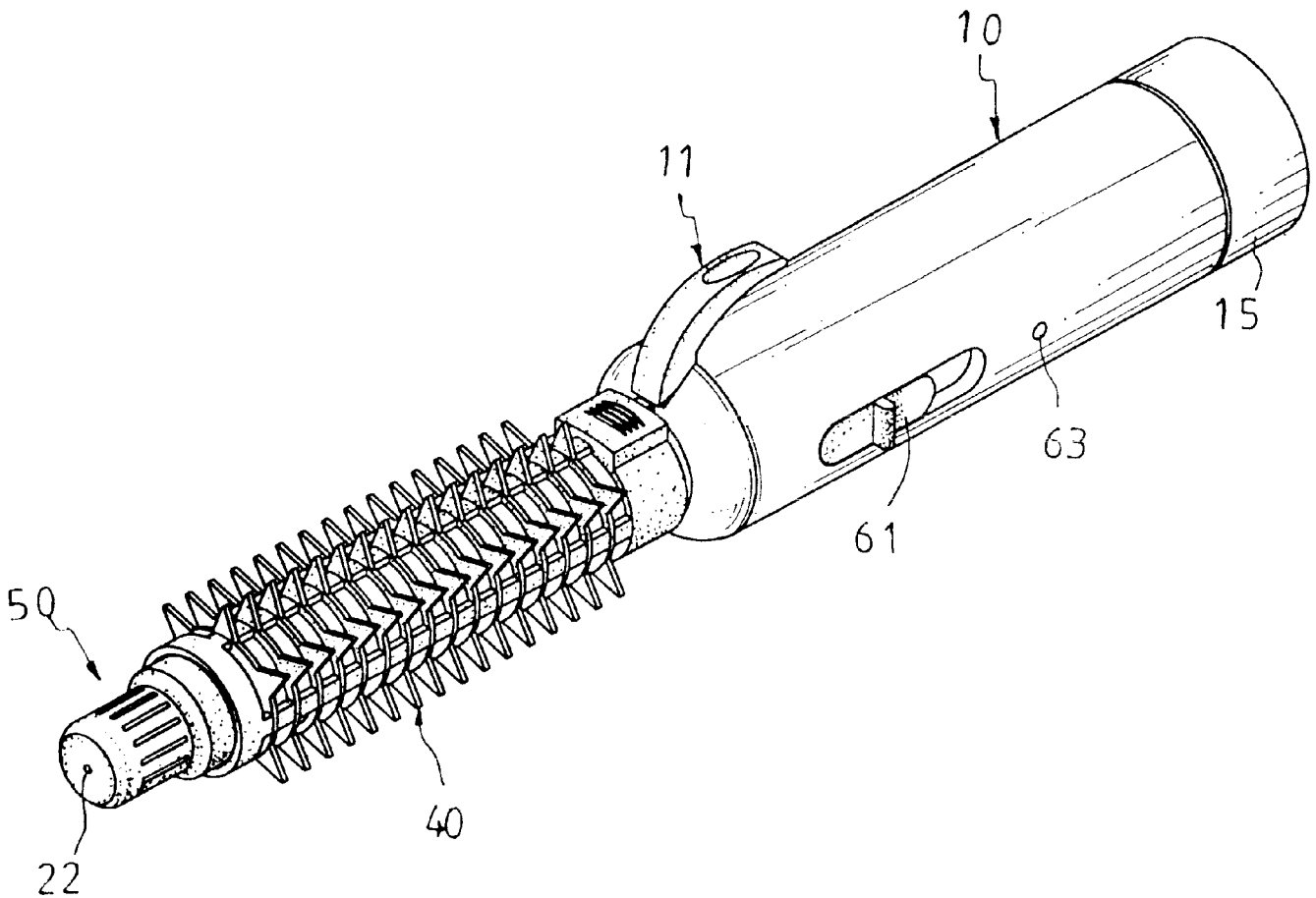
FIG. 1 is a perspective view of a portable hair curler having a lamp type heat source member in accordance with a first embodiment of the present invention.
Figure 2:
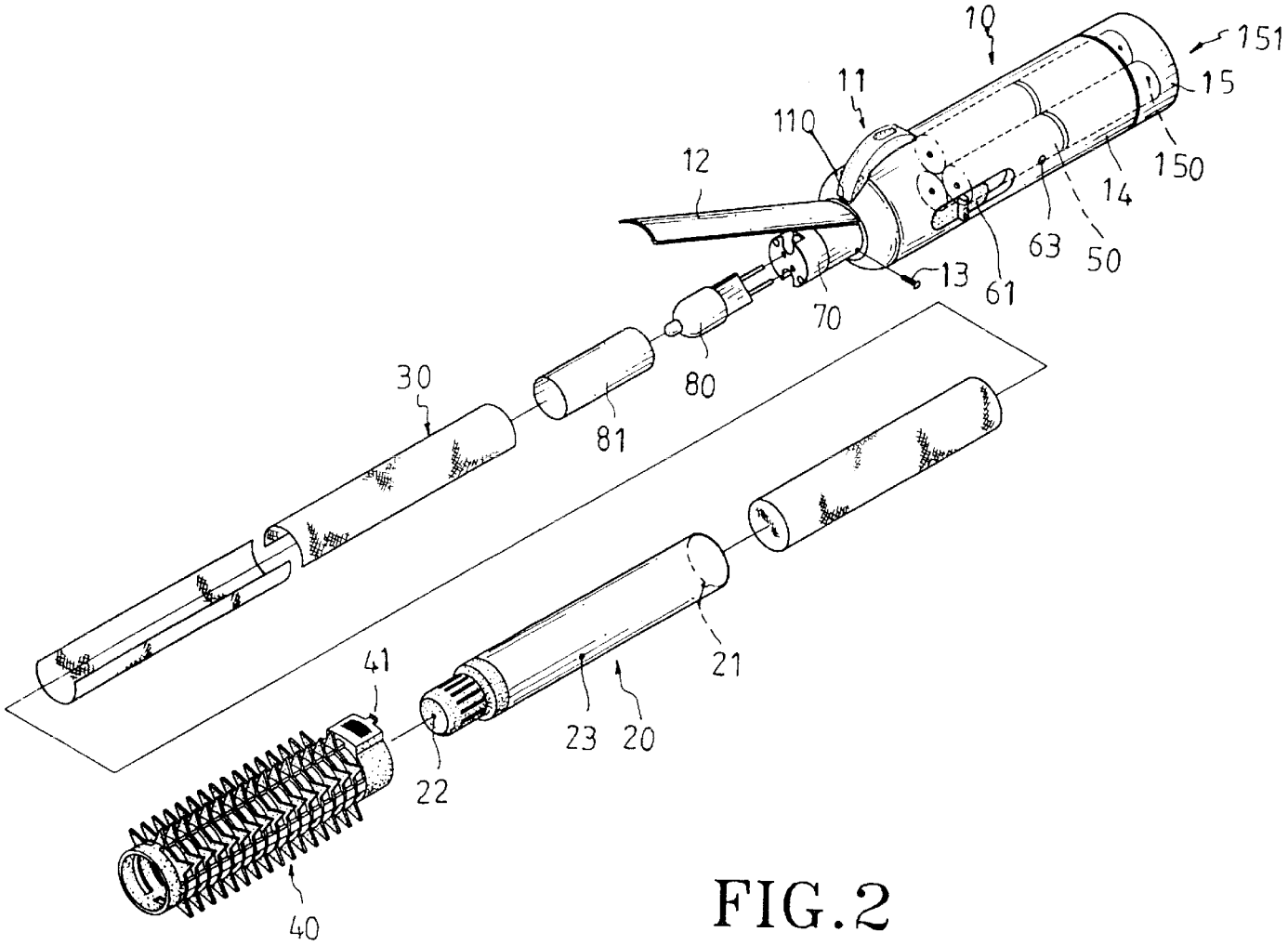
FIG. 2 is an exploded perspective assembly view of the portable hair curler having a lamp type heat source member as shown in FIG. 1.
Figure 3:
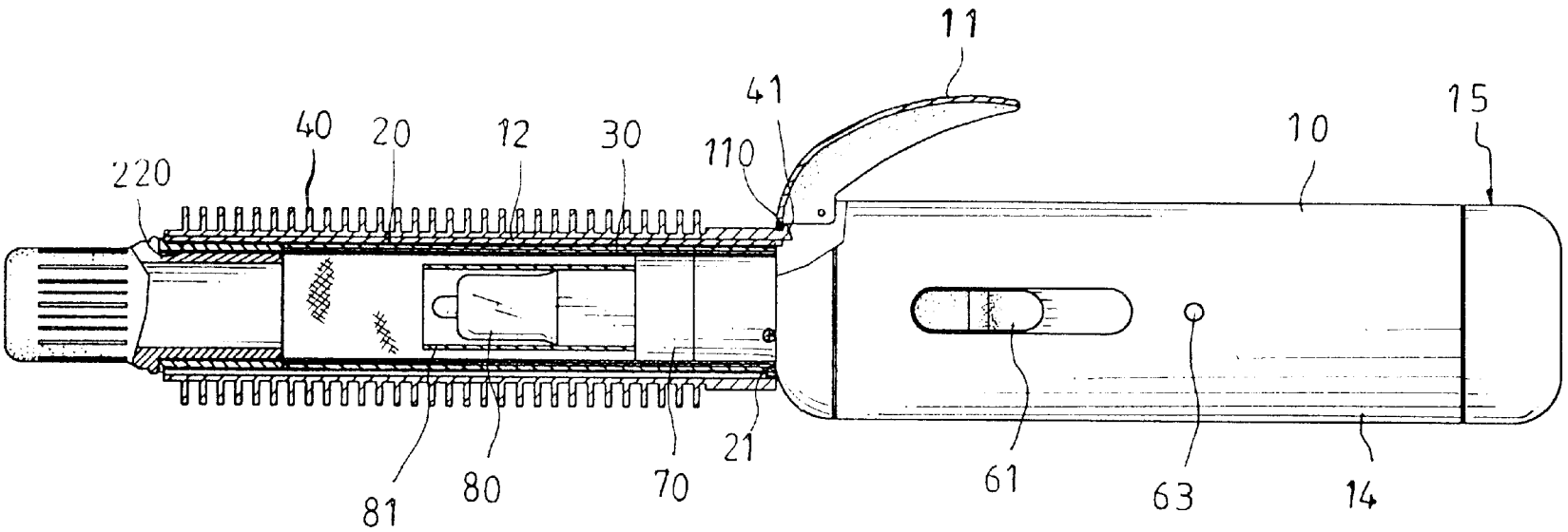
FIG. 3 is a partially cross-sectional view of the portable hair curler having a lamp type heat source member as shown in FIG. 1.

Referring to the drawings and initially to FIGS. 1–3, a portable hair curler having a lamp type heat source member in accordance with a first embodiment of the present invention comprises a handle 10 having a first end provided with a heat emitting housing 20 which contains a net-shaped heat-sink member 30 therein, and a hair roller member 40 may be mounted on the outside of the heat emitting housing 20.

The first end of the handle 10 is provided with a tongue 12, and a thumb press 11 for elastically pressing the tongue 12 to mate with the heat emitting housing 20 to clip and hold the hair. The thumb press 11 of the handle 10 has an end face provided with a locking hole 110. The hair roller member 40 is provided with an elastic locking portion 41 that may be snapped into the locking hole 110 of the thumb press 11 of the handle 10, so that the hair roller member 40 may be freely mounted on or removed from the heat emitting housing 20.

The heat emitting housing 20 has a first end defining a recessed positioning portion 21. A fixing bolt 13 is extended through the recessed positioning portion 21 of the heat emitting housing 20, and is screwed into the first end of the handle 10, such that the first end of the heat emitting housing 20 may be positioned on the first end of the handle 10. The heat emitting housing 20 has a second end provided with a display window 22 that may indicate signals during the heating process of the heat emitting housing 20. A heat isolation member 220 (see FIG. 3) is mounted on the connecting portion of the display window 22 and the heat emitting housing 20.

The net-shaped heat-sink member 30 is mounted in the hollow inner wall of the heat emitting housing 20, so that the heat may be evenly distributed around the periphery of the heat emitting housing 20 through the net-shaped heat-sink member 30.

The handle 10 has a second provided with a hollow power supply chamber 14 for receiving therein at least one electric source member 50 (such as a battery) that is charged previously. A battery cover 15 is mounted on an end opening of the power supply chamber 14, and has a first side provided with at least one charging terminal 150 that contacts the electric source member 50, and a second side provided with a charging receptacle 151 for the charging use.

A control circuit member 60 (see FIG. 7) is mounted in the power supply chamber 14, and includes a switch 61 mounted on the outside of the handle 10 to connect or disconnect the electric power, a normally closed safety switch 62, and an LED display lamp 63 mounted on the handle 10 to indicate the heating state.

A heat emitting lamp seat 70 has a first end mounted on the first end of the handle 10 and electrically connected to the electric source member 50. A lamp type heat source member 80 (such as an electric bulb) is inserted on a second end of the heat emitting lamp seat 70. Thus, the control circuit member 60 may be controlled by the switch 61 to supply the electric power to the heat emitting lamp seat 70, so that the lamp type heat source member 80 may be heated or turned off.

A transparent guard shade 81 is mounted on the outside of the lamp type heat source member 80, so that the light source and heat source of the lamp type heat source member 80 may be transmitted through the transparent guard shade 81 to the net-shaped heat-sink member 30 and the heat emitting housing 20.

A display window 23 is defined through the heat emitting housing 20, and aligned with the lamp type heat source member 80, so that the user may directly inspect the state of the lamp type heat source member 80 through the display window 23.

Figure 4:
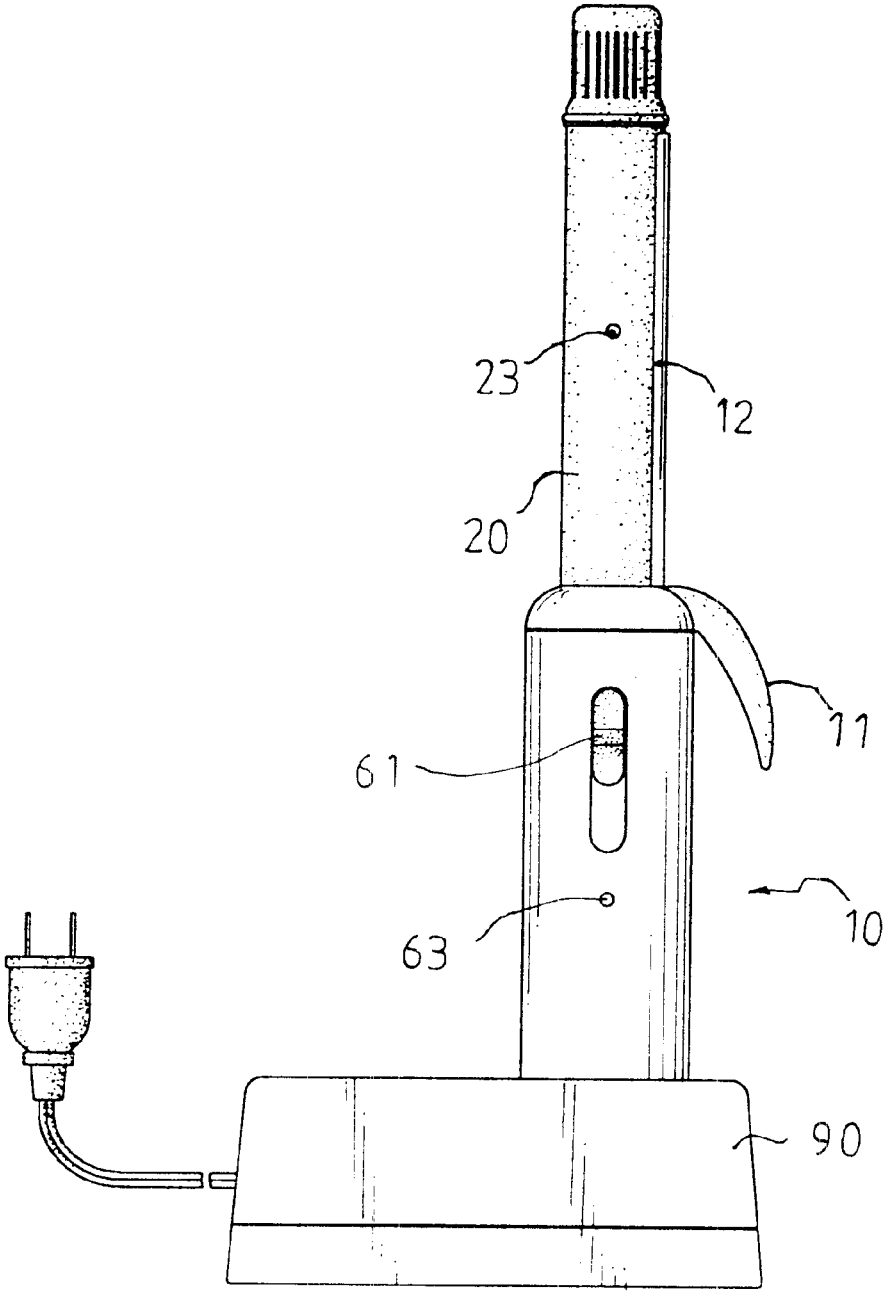
FIG. 4 is a plan view of the portable hair curler having a lamp type heat source member and a charging member as shown in FIG. 1.

Referring to FIG. 4, before the portable hair curler in accordance with the present invention is used, a charging member 90 may be mounted on the charging receptacle 151 of the battery cover 15 to charge the electric source member 50 in the hollow power supply chamber 14. In use, the portable hair curler in accordance with the present invention may be directly taken out, and the switch 61 may be pressed, so that the lamp type heat source member 80 on the heat emitting lamp seat 70 may emit heat for use of the user.

Figure 5:
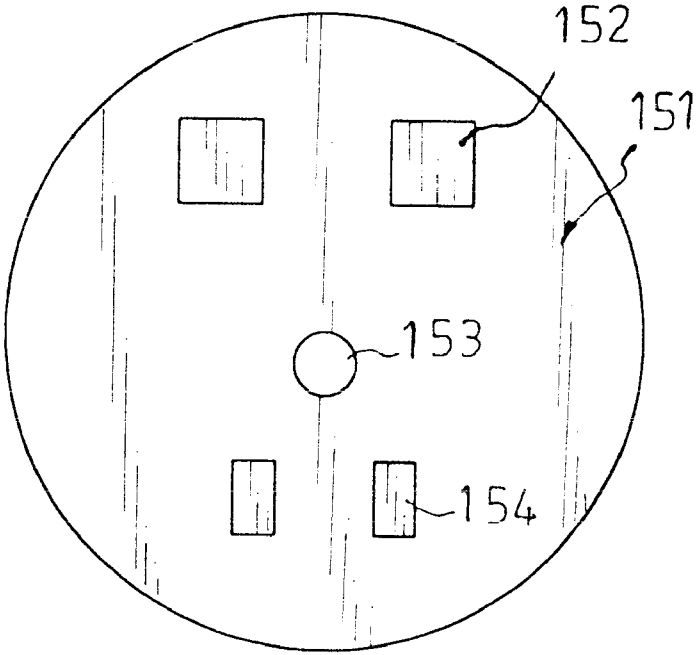
FIG. 5 is a plan view of a battery cover of the portable hair curler having a lamp type heat source member as shown in FIG. 1.
Figure 6:
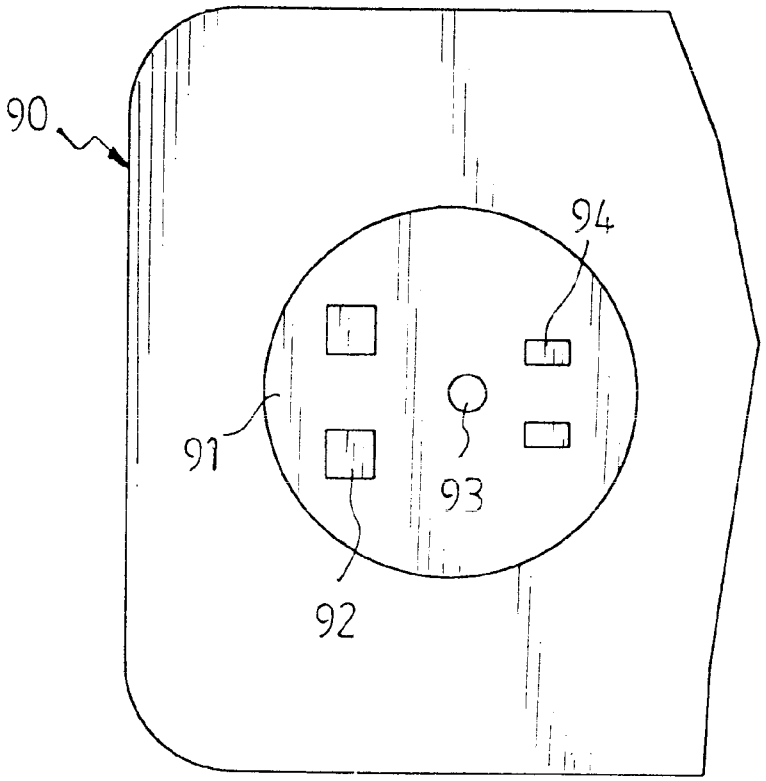
FIG. 6 is a plan view of the charging member as shown in FIG. 4.

Referring now to FIGS. 4–7 with reference to FIGS. 1–3, the charging member 90 is provided with a charging receptacle 91 which is provided with a pair of charging terminals 92, a protruding push member 93, and a pair of heating terminals 94 as shown in FIG. 6. The charging receptacle 151 of the battery cover 15 is provided with a pair of charging terminals 152, a through push hole 153, and a pair of heating terminals 154 as shown in FIG. 5.

Figure 7:
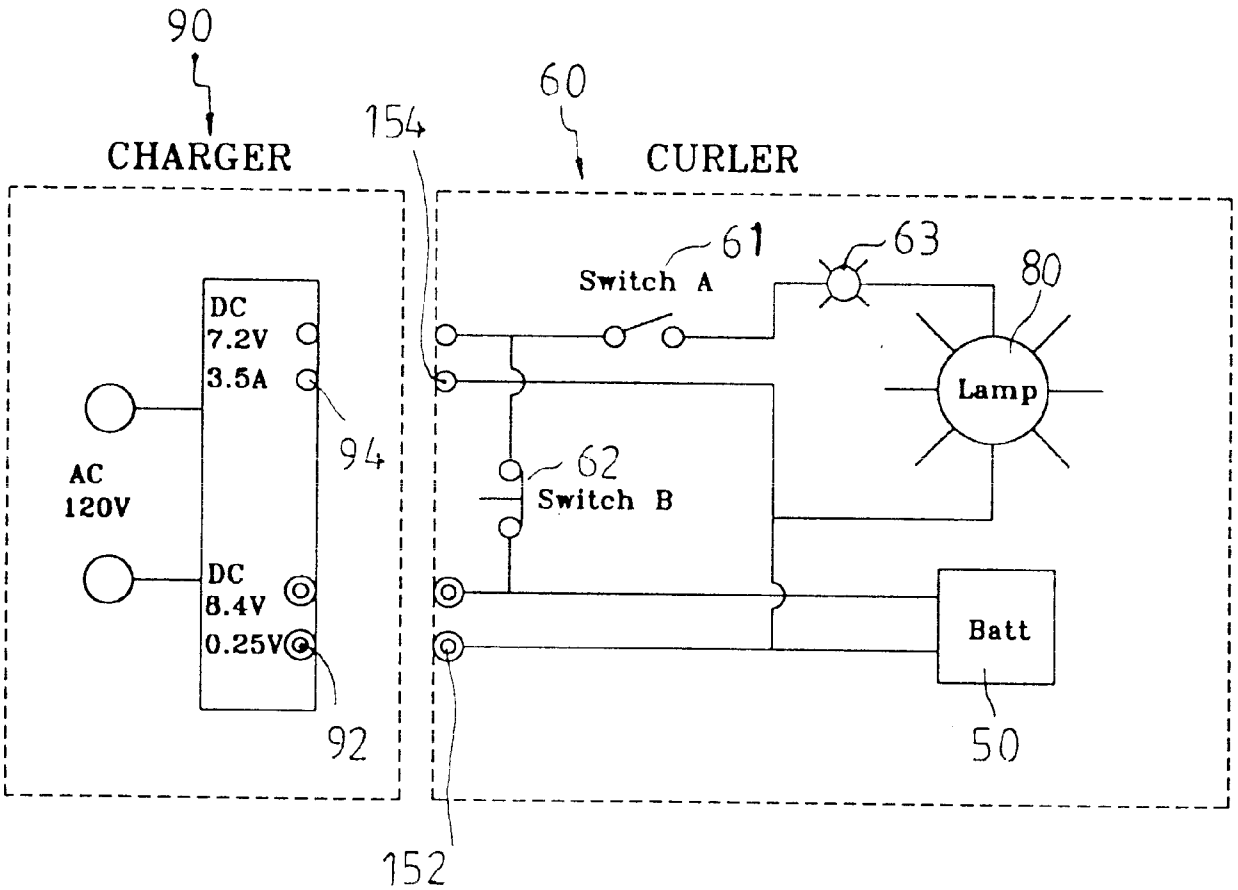
FIG. 7 is a circuit diagram of the portable hair curler having a lamp type heat source member as shown in FIG. 1.

The normally closed safety switch 62 of the control circuit member 60 is mounted on the connecting line of the electric source member 50 and the lamp type heat source member 80 as shown in FIG. 7.

Thus, when the charging receptacle 151 of the battery cover 15 of the portable hair curler in accordance with the present invention is inserted on the charging member 90 as shown in FIGS. 4 and 7, the protruding push member 93 of the charging member 90 may pass through the push hole 153 to push away the normally closed safety switch 62, thereby shutting off connection of the electric source member 50 and the lamp type heat source member 80. Thus, the heating terminals 94 contact the heating terminals 154, and the switch 61 may be directly pressed, so that the lamp type heat source member 80 may be energized and heated.

After the charging receptacle 151 of the battery cover 15 of the portable hair curler in accordance with the present invention is removed from the charging member 90, the normally closed safety switch 62 may be returned to its original state. Thus, when the switch 61 is pressed, the lamp type heat source member 80 may be energized and heated.

Accordingly, the portable hair curler in accordance with the present invention has the following advantages.

1. The electric source member 50 may be charged previously to supply the electric power to the lamp type heat source member 80, so that the lamp type heat source member 80 may be heated and used under the condition of lack of electricity, thereby enhancing the versatility of the portable hair curler.
2. The portable hair curler may be used without needing any electric cord, so that operation of the portable hair curler will not be interrupted by the electric cord, thereby facilitating the user using the portable hair curler.
3. The portable hair curler may be used by heating the lamp type heat source member 80 that is cheap and may be purchased easily, thereby greatly decreasing the cost of fabrication.
4. The lamp type heat source member 80 is protected by the guard shade 81, so that the portable hair curler may be used normally. In addition, the lamp type heat source member 80 may be replaced easily, thereby facilitating maintenance of the portable hair curler.
5. The lamp type heat source member 80 may function as an ordinary electric bulb when used outdoors so as to provide the light source, thereby enhancing the versatility of the portable hair curler.

Figure 8:
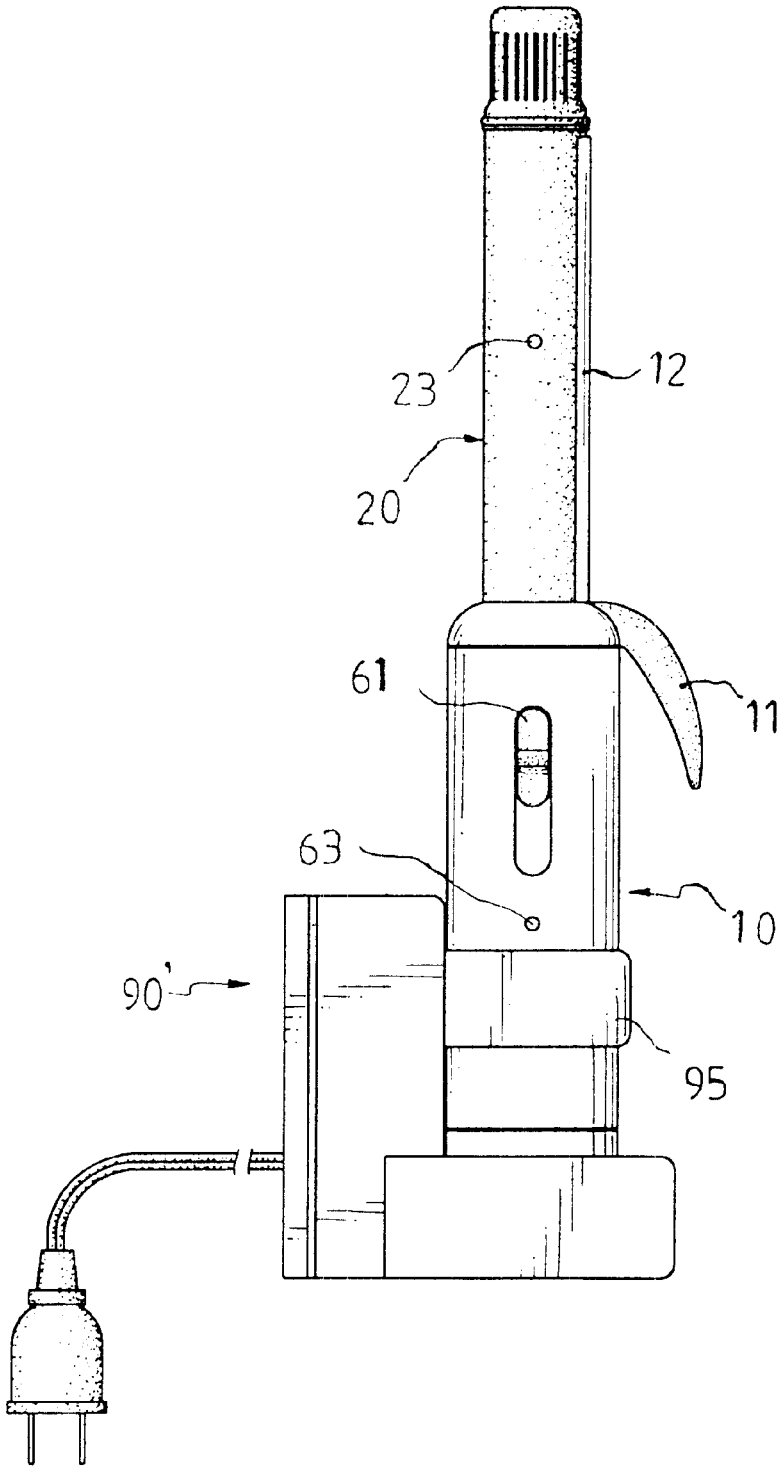
FIG. 8 is a plan view of the portable hair curler having a lamp type heat source member in accordance with a second embodiment of the present invention.

Referring to FIG. 8, in accordance with a second embodiment of the present invention, the charging member 90' is substantially L-shaped, and includes a holding member 95 (such as a C-shaped snap) for clamping the handle 10, so that the charging process may be performed stably.

Figure 9:
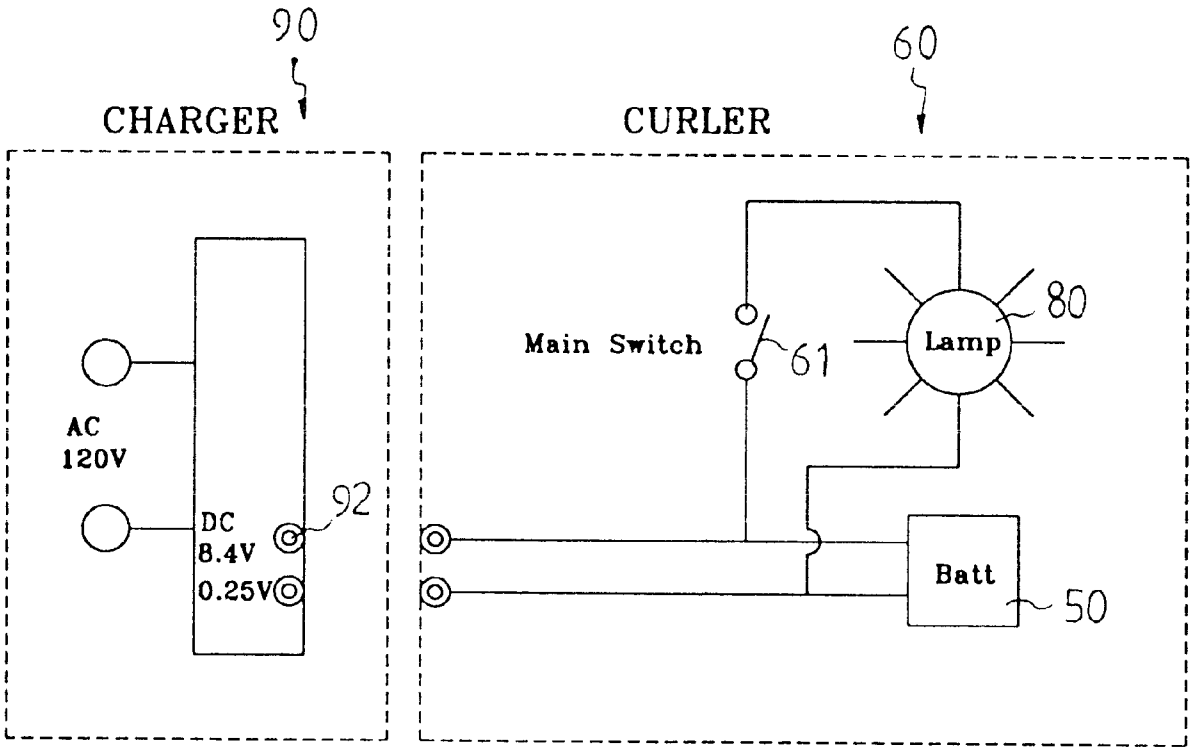
FIG. 9 is a circuit diagram of the portable hair curler having a lamp type heat source member in accordance with the third embodiment of the present invention.

Referring to FIG. 9, in accordance with a third embodiment of the present invention, the normally closed safety switch 62 is undefined, and the control circuit member 60 is directly controlled by the switch 61. The charging receptacle 91 of the charging member 90 only has the charging terminals 92.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A portable hair curler having a lamp type heat source member, comprising:

a handle having a first end provided with a heat emitting housing which contains a net-shaped heat-sink member therein, and a hair roller member mounted on an outside of the heat emitting housing;

the first end of the handle being provided with a tongue, and a thumb press for elastically pressing the tongue to mate with the heat emitting housing to clip and hold hair;

the thumb press of the handle having an end face provided with a locking hole, the hair roller member being provided with an elastic locking portion that may be snapped into the locking hole of the thumb press of the handle;

the net-shaped heat-sink member being mounted in a hollow inner wall of the heat emitting housing, so that heat may be evenly distributed around a periphery of the heat emitting housing through the net-shaped heat-sink member;

wherein:

the handle has a second end provided with a hollow power supply chamber for receiving therein at least one chargeable electric source member, a control circuit member is mounted in the power supply chamber, a heat emitting lamp seat has a first end mounted on the first end of the handle and electrically connected to the electric source member, a lamp type heat source member is inserted on a second end of the heat emitting lamp seat, the control circuit member being controlled by a switch to supply electric power to the heat emitting lamp seat, so that the lamp type heat source member may be heated or turned off.

2. The portable hair curler having a lamp type heat source member in accordance with claim 1, further comprising a battery cover mounted on an end opening of the power supply chamber, and having a first side provided with at least one charging terminal that contacts the electric source member, and a second side provided with a charging receptacle for a charging use.

3. The portable hair curler having a lamp type heat source member in accordance with claim 2, further comprising a charging member mounted on the charging receptacle of the battery cover so as to charge the electric source member in the hollow power supply chamber.

4. The portable hair curler having a lamp type heat source member in accordance with claim 3, wherein the control circuit member is provided with a normally closed safety switch mounted on a connecting line of the electric source member and the lamp type heat source member, the charging member is provided with a charging receptacle which is provided with a pair of charging terminals, a protruding push member, and a pair of heating terminals, and the charging receptacle of the battery cover is provided with a pair of charging terminals, a through push hole, and a pair of heating terminals.

5. The portable hair curler having a lamp type heat source member in accordance with claim 4, wherein the control circuit member is directly controlled by a switch, and the charging receptacle of the charging member only has the charging terminals.

6. The portable hair curler having a lamp type heat source member in accordance with claim 1, wherein the control circuit member includes an LED display lamp mounted on the handle to indicate a heating state.

7. The portable hair curler having a lamp type heat source member in accordance with claim 1, further comprising a transparent guard shade mounted on an outside of the lamp type heat source member, so that the light source and heat source of the lamp type heat source member is transmitted through the transparent guard shade to the net-shaped heat-sink member and the heat emitting housing.

8. The portable hair curler having a lamp type heat source member in accordance with claim 1, wherein the heat emitting housing defines a display window aligned with the lamp type heat source member, so that a user may directly inspect a state of the lamp type heat source member through the display window.

9. The portable hair curler having a lamp type heat source member in accordance with claim 1, further comprising a charging member wherein the charging member, is substantially L-shaped, and includes a holding member for clamping the handle, so that a charging process may be performed stably.

* * * * *

UNITED STATES PATENT AND TRADEMARK OFFICE

CERTIFICATE OF CORRECTION

PATENT NO. : 6,423,942 B1
DATED : July 23, 2002
INVENTOR(S) : Liao

It is certified that error appears in the above-identified patent and that said Letters Patent is hereby corrected as shown below:

Title page,
Item [73], Assignee, should read -- Manica-Taiwan, Incorporated, Tantau (TW) --

Signed and Sealed this

Twenty-first Day of October, 2003

JAMES E. ROGAN
*Director of the United States Patent and Trademark Office*